US007913321B2

(12) United States Patent
Radcliffe et al.

(10) Patent No.: US 7,913,321 B2
(45) Date of Patent: Mar. 29, 2011

(54) CHILD CARRIER COVER

(76) Inventors: David Hamilton Radcliffe, Denver, CO (US); Melissa Roth Radcliffe, Denver, CO (US)

( * ) Notice: Subject to any disclaimer, the term of this patent is extended or adjusted under 35 U.S.C. 154(b) by 85 days.

(21) Appl. No.: 11/779,515

(22) Filed: Jul. 18, 2007

(65) Prior Publication Data

US 2009/0019621 A1 Jan. 22, 2009

Related U.S. Application Data

(60) Provisional application No. 60/835,054, filed on Aug. 3, 2006.

(51) Int. Cl.
*A41D 1/00* (2006.01)

(52) U.S. Cl. ..... 2/69; 2/48; 2/106; 2/104; 2/115

(58) Field of Classification Search ..... 2/106, 104, 2/80, 115, 48, 84; 224/576, 158, 159
See application file for complete search history.

(56) References Cited

U.S. PATENT DOCUMENTS

| | | | | |
|---|---|---|---|---|
| 1,927,179 | A * | 9/1933 | Levinsohn | 2/102 |
| 3,116,491 | A * | 1/1964 | Previdi et al. | 2/106 |
| 3,276,036 | A * | 10/1966 | Cater et al. | 2/114 |
| 3,481,517 | A * | 12/1969 | Aukerman | 224/160 |
| 5,946,725 | A * | 9/1999 | Shatzkin et al. | 2/106 |
| 6,014,772 | A * | 1/2000 | Connelly | 2/69 |
| 6,434,727 | B1 * | 8/2002 | Ishii et al. | 716/6 |
| 6,536,047 | B1 * | 3/2003 | Mullaly | 2/48 |
| 7,296,303 | B1 * | 11/2007 | Samet | 2/115 |
| 2006/0005294 | A1 * | 1/2006 | Fugazzi | 2/115 |
| 2008/0256679 | A1 * | 10/2008 | White | 2/84 |

OTHER PUBLICATIONS http://store.peppermint.com/aiska-poncho.html.
http://store.peppermint.com/felix-pera-coat.html.

* cited by examiner

*Primary Examiner* — Gary L Welch
*Assistant Examiner* — Alissa J Tompkins
(74) *Attorney, Agent, or Firm* — Alston & Bird LLP

(57) ABSTRACT

A garment for covering a user and a child supported in a child carrier that has a layer of material with a first opening in the layer constructed and arranged to accommodate the head of the user. The garment also has a second opening in the layer constructed and arranged to accommodate the head of the child. The garment is constructed and arranged to be worn by the user to protect the user and the child from the elements.

19 Claims, 4 Drawing Sheets

CHILD CARRIER COVER

CROSS REFERENCE TO RELATED APPLICATIONS

This application is related to commonly owned Provisional Application Ser. No. 60/835,054, filed Aug. 3, 2006, incorporated herein by reference in its entirety, and claims the benefit of its earlier filing date under 35 U.S.C. 119(e).

FIELD OF THE INVENTION

The present invention relates to a device for protecting a small child or infant from the elements while it is being carried by an individual.

BACKGROUND OF THE INVENTION

There are currently many devices on the market which facilitate the convenient carrying of an infant or a small child. Many of these devices employ a system of straps and harnesses to secure the child to an individual's front or back side. For example, some devices function as a backpack and carry the child in a seated or upright position on the back of the adult. In contrast, other devices carry the child on the front of the adult, such that the child is in an upright or seated position. When the child is positioned on the front side of the adult, the child can either face the adult or face away from the adult. Additionally, there are devices that are structured like slings to carry the child in a semi-upright position where in the child's body may be oriented in any number of positions relative to the adult.

An adult desiring to carry a child in one of these prior art devices during the winter must first put a jacket on themselves before donning whatever child carrying device they are employing. Because many of these child carrying devices employ straps of varying sizes that must be fitted to the individual, placing the child carrying device on over jackets or other colder weather clothing will require an adjustment of the child carrying device's straps. In addition to the adult having to put on a jacket prior to donning the child carrying device, the child must also put on warmer clothing. This can affect the fit of the child carrying device, which can require the adult to adjust the fitment of the device. Merely placing the child carrier device over the warmer clothing of the child and the adult can cause the device to compress the clothing and adversely impact the insulating qualities of the clothing. Alternatively, waterproof or water-resistant materials used as the outer layer may be compressed against the skin of the adult and the child, which can adversely impact the breathability of the garment.

Additionally, there are certain products that are designed to enclose both the adult and the child but which are cumbersome and difficult to put on or take off. For example, there are certain products that are similar to a pullover garment and simply have an opening for the adult's head and an opening for the child's head. Putting this device on requires that the adult guide the child's head through the opening at the same time as the adult is trying to guide their head through the opening, all while the adult is trying to guide their arms though the designated openings. This type of motion is prohibitively difficult when carrying a child in a child carrier, as the adult is not able to simultaneously place his or her arms through the device while at the same time guiding a child's head and their head into the bottom of the garment and through the opening. Some products attempted to solve this problem by designing a product that is open at the bottom and which does not have armholes. These products, which are similar to ponchos, are not closed at the bottom of the garment or on its sides. This design provides marginal protection from the elements, allows a large amount of heat to escape, and is cumbersome to wear. There are also products that are enclosed at the bottom but which have no armholes. These products, which can be analogized to a "body sock" with headholes for the adult and child, do not allow for the adult's arms to exit the device, thereby allowing for the device to be easily put on but severly limiting the range and type of activities in which the adult can take part.

Alternatively, there are products that employ one or more zip-in inserts to accommodate a device that accommodates the child's head. These devices are also difficult to use, as they require the adult to zip in the insert while the child is being carried by the adult. These devices are more costly to produce due to additional zipper materials. Moreover, these devices lose significant amounts of heat through the multiple zippers and the insert, if lost or misplaced, renders the device unusable as a child carrier cover. This device also has two zippers up the front of the device, an undesired attribute that not only makes it difficult to zip in the insert, but also places the rough surface of zippers near the sensitive skin of a child. The placement of zippers, hook and loop attachment surfaces, or other attachment mechanisms near a child's skin is undesirable as it can cause significant discomfort to the child. Finally, the zip-in insert design provides for a common hole through which the adult and child's heads must protrude. As there will need to be a certain amount of space between the adult and the child, this design also allows a great amount of heat to escape from the jacket or, if it is raining or snowing, allows the precipitation to fall on the inside of the device. These design flaws clearly detract from the present devices' effectiveness and marketability.

There is thus the need for a device that provides the protection and benefits of a jacket that encloses both the adult and the child but which is easy to put on and take off.

SUMMARY OF THE INVENTION

One aspect of the invention includes providing a device that allows for the comfortable and secure use of a child carrier device on an adult while ensuring that the child is comfortably and securely positioned within the device and protected from the elements. An object of the invention provides for a device for covering an adult, a child carrier device, and a child, the device including a first opening that is designed to accommodate the head of the adult wearing the device, and a second opening that is designed to accommodate the head of the child being carried in the child carrier device which is strapped or affixed to the adult, while the device encloses the torso of the adult and nearly the entire body of the child.

Another aspect of the invention includes a method for carrying and covering a child. This method includes placing a child carrying device on an adult, placing a child in a child carrying device, and covering the adult and the child with a garment comprising a first opening and a second opening. The first opening receives the head of the adult, and the second opening receives the head of the child. This method results in a garment that covers both the adult and the child and protects both from the elements.

Other objects, features, and advantages of the present invention will be appreciated from the following detailed description, the accompanying drawings, and the appended claims.

DETAILED DESCRIPTION OF ILLUSTRATED EMBODIMENT OF THE INVENTION

Figure 1:
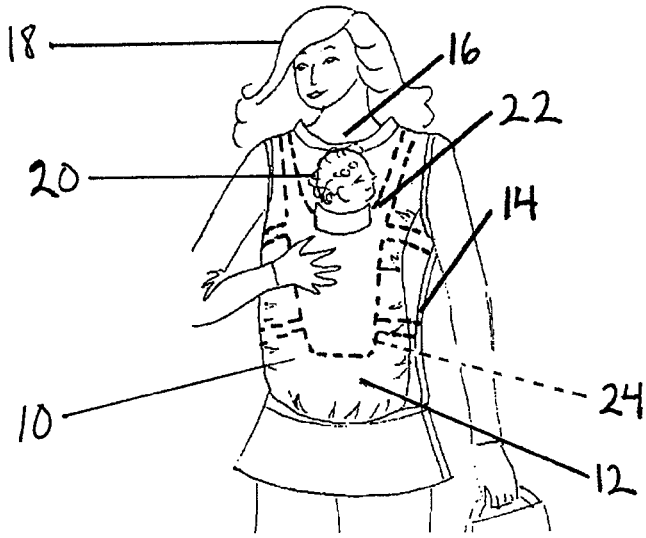
FIG. 1 is a front view of the child carrier cover on a user in accordance with one embodiment of the subject invention.
Figure 2:
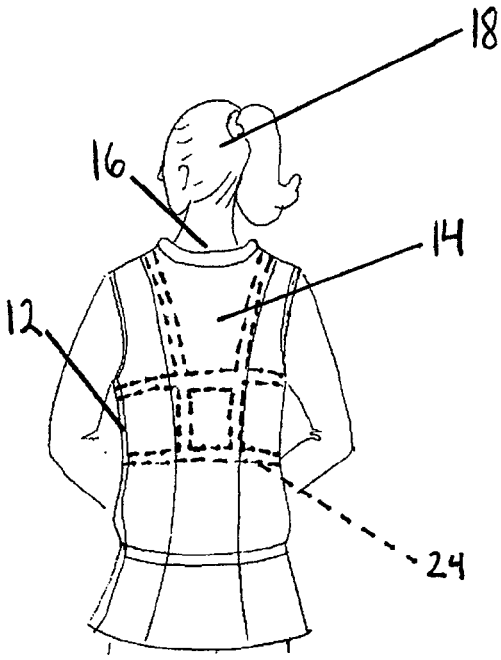
FIG. 2 is back view of the child carrier cover of FIG. 1.
Figure 3:
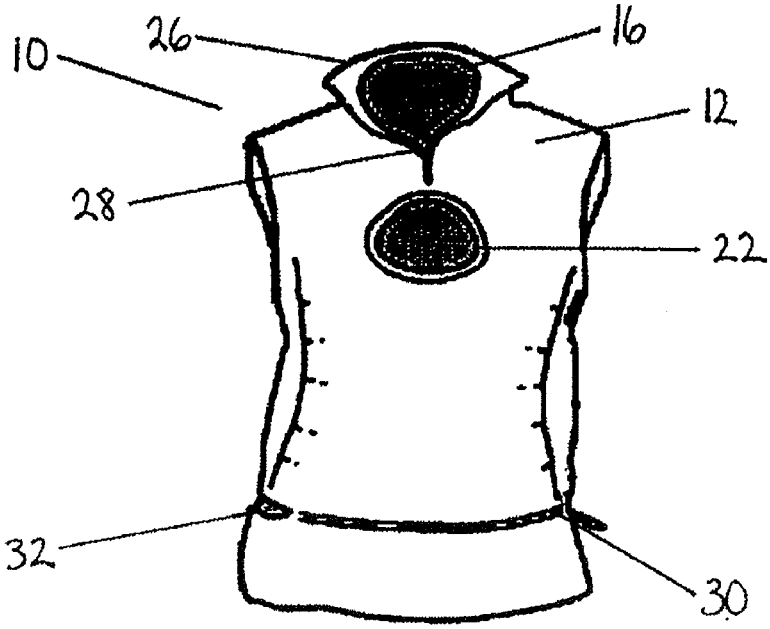
FIG. 3 is a plain view of the child carrier cover of FIG. 1.
Figure 4:
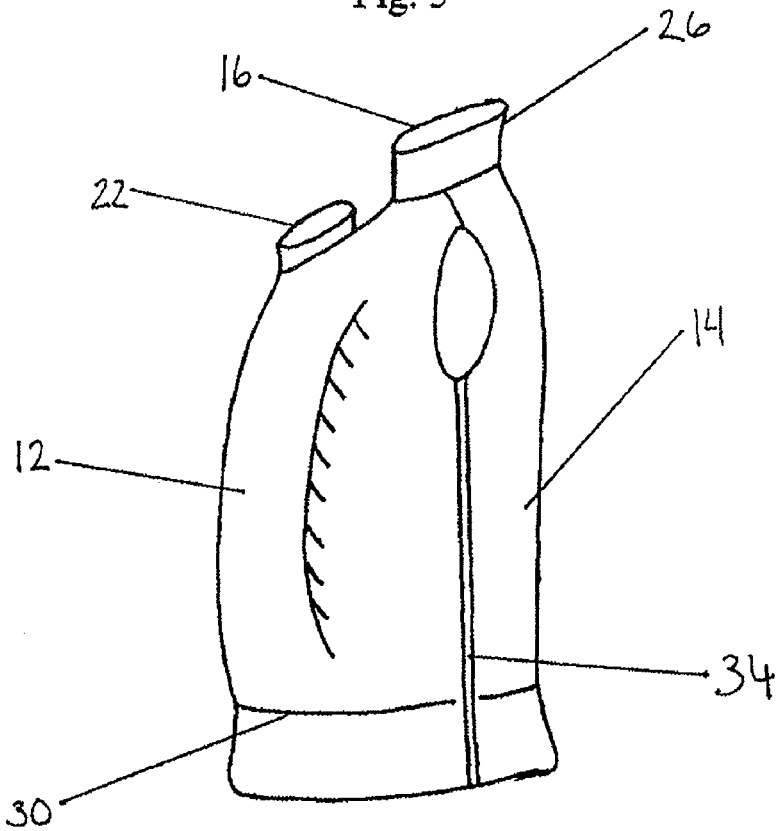
FIG. 4 is a side view of the child carrier cover of FIG. 1.

One embodiment of the present invention provides for a child carrier cover for use by an adult carrying a child. When a child is in a child carrying device that is strapped or affixed to the adult, the adult may use the child carrier cover to cover themselves, the child, and the child carrying device. By placing the child carrier cover over both the adult and the child, the child carrier cover can provide greater warmth and comfort for both the child and the adult. The child carrier cover may have two neck holes, and can be designed to appear similar to a pullover jacket or vest. In addition, one side of the child carrier cover can be open to allow the garment to be put on easily, while retaining the same appearance and utility. The side of the child carrier cover can be secured, for example, by using hook-and-loop type fasteners, snaps, zippers, or buttons. The child carrier cover can be manufactured from any appropriate material, including waterproof and insulating material, to allow for a range of functional environments and temperatures.

One illustrated embodiment of the invention is shown in the figures as a child carrier cover 10. The figures illustrate child carrier cover 10 being worn by an adult 18 who is carrying a child 20 by using a child carrier device 24. Child carrier cover 10 has a first side 12 and a second side 14. In addition, child carrier cover 10 has a first opening 16 designed to accommodate the head of the adult 18 that is carrying the child 20. The first opening 16 may be of any particular shape that allows for the head of the adult 18 to comfortably protrude from the child carrier cover 10. There is also a second opening 22 which is designed to accommodate the head of the child 20. Second opening 22 may also be of any particular shape that allows for the head of the child 20 to comfortably protrude from the child carrier cover 10. The openings 16 and 22 may also be adjustable.

Child carrier cover 10 may be made from any suitable material, including but not limited to polyethylene terephthalate (commonly known as "Polar Fleece"), nylon, felt, cotton, denim, flannel, wool, Gore-tex®, down, or any other appropriate material, including materials with thermal or weather resistant characteristics. Alternatively, child carrier cover 10 may be made from a lightweight material such as a mesh, to provide protection from insects, or a lightweight material with UVA/UVB protection to shield against the harmful rays of the sun. Each of first opening 16 and second opening 22 may be defined by a collar 26 made from any of the above referenced materials, or may be made from nylon, spandex, or any other suitable material.

First opening 16 and second opening 22 may be adjusted in size through use of a zipper that extends radially from the edge of first opening 16 or the second opening 22 to allow the child carrier cover 10 to be drawn over the head easier. There may be a flap 28 that is cut into the fabric of child carrier cover 10 that extends radially from the edge of first opening 16 or the second opening 22 and which has a fastening system, such as a hook-and-loop type closure system, snap closure system, or any other appropriate closure system that allows the aperture of first opening 16 or second opening 22 to change so as to accommodate the head of the appropriate person.

The first side 12 and the second side 14 of child carrier cover 10 may be sewn together or otherwise affixed such that the child carrier cover 10 may be pulled over the adult 18 and child 20 in a similar fashion as a pullover garment. In this configuration, the first side 12 and second side 14 may be manufactured from two or more separate pieces of material, or may be one continuous piece of material, which is joined together on one side. When child carrier cover 10 is made from two or more separate pieces of fabric, first side 12 and second side 14 may be affixed on only one side, while the other side of child carrier cover 10 allows for the temporary but secure attachment of first side 12 and second side 14. The temporary attachment of first side 12 and second side 14 can be achieved by any appropriate releasably securable fastener, including, for example, a zipper, a hook-and-loop type closure system, or a snap closure system. The ability to secure the device on the side of the garment is advantageous, as it is much easier to secure the device on the side than to have to secure the device on the front (by way of, for example, zips or hook-and-loop attachment methods). This ability to secure the child carrier cover 10 on the side allows the adult 18 to put the child carrier cover 10 on much easier, as the adult only needs to put one arm into the armhole located on the permanently secured side of the cover 10 before affixing the device on the other side. Because the adult 18 only needs to put one arm through an armhole, it is much easier to guide the head of the child 20 though the appropriate opening and to secure the open side of the child carrier cover 10. By having one zipper located on the side, the child carrier cover 10 is not only less expensive to produce as compared to designs that employ multiple zippers due simply to the material costs, but the claimed invention also provides greater warmth and protection from the elements as it has fewer openings that expose bodies of the child 20 and the adult 18. Thus, this design offers significant advantages over previous designs.

Figure 7:
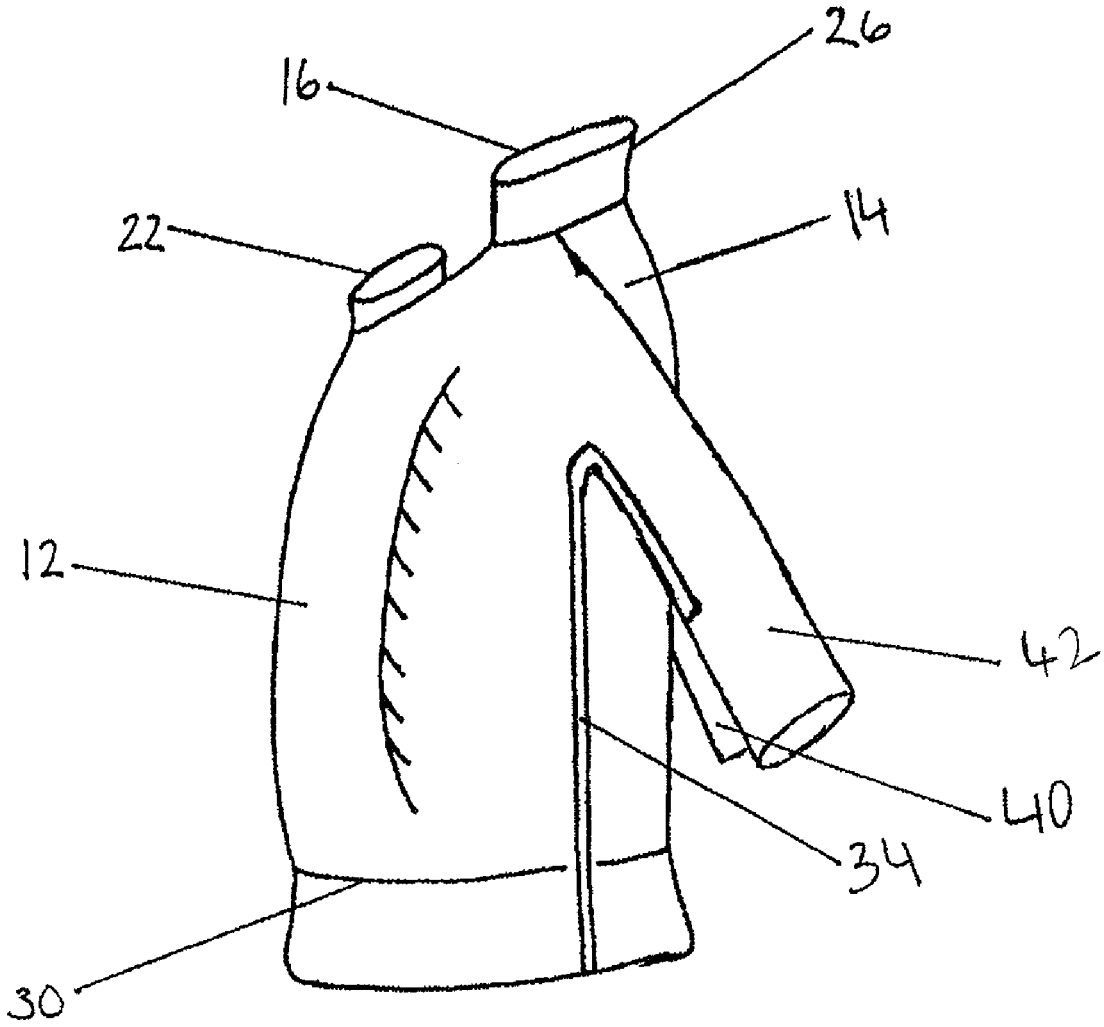
FIG. 7 is yet another side view of the child carrier cover.

In one embodiment, the child carrier cover 10 will use a zipper to secure the first side 12 and second side 14. This zipper may be located on the side of the device and may extend from the bottom of the child carrier cover 10 to the underside of the armhole on the same side of the device. Thus, to secure the sides of the child carrier cover 10, the adult merely needs to zip up the device from the bottom of the device to the bottom of the armhole. By orienting the zipper such that it closes the aperture 34 as it moves upwards, the adult 18 may easily see the zipper as he or she is engaging both sides of the zipper and zipping it up, and allows for a natural zipping motion. Alternatively, the zipper may be oriented such that it closes the aperture 34 as it moves downwards. Although this configuration may be adapted to any embodiment of the claimed invention, it is particularly well suited if the child carrier cover 10 has long sleeves 40 and 42 extending from the armholes. In such a design, the zipper may extend down part or all of the sleeve, which not only allows the adult 18 to "open up" the sleeve by unzipping it and thereby allowing for greater ease of entry, but also allows the adult 18 to secure the open aperture 34 of the child carrier cover 10, as shown in FIG. 7, by raising his or her arm and pulling downward on the zipper. This motion would be similar to the motion used by individuals wearing a jacket with underarm ventilation zippers to open or close the vents.

When the adult 18 is carrying the child 20, the child 20 may be enclosed within the child carrier cover 10 such that only the head of the child 20 is visible from the exterior of the child carrier cover 10. By covering the entire child 20 except for the head, the child carrier cover 10 protects the child 20 from the various elements, such as damaging sun rays, cold temperatures, or inclement weather. In addition, by creating a seal around the neck of child 20, second opening 22 may trap body heat within the baby carrier cover 10 and increase the warmth inside the device. The material between the apertures accommodating the head of the child 20 and the adult 18 also provides a desirable soft location for the head of the child 20. This soft location is a desirable attribute insofar as it makes the child 20 more comfortable and allows the child to lay its head down on the chest of the adult 18 with a soft protective layer between the adult 18 and the child 20.

Although only one child carrier device 24 is illustrated, the child carrier cover 10 may accommodate various child carrier devices 24. Child carrier cover 10 may be designed to be loose enough and sufficiently large to allow it to accommodate any number of different child carrier devices. To minimize the amount of excess fabric, the child carrier cover 10 may be made of a material with sufficient elasticity to allow for child carrier devices of varying sizes and shapes while not appearing too bulky. In the event that child carrier cover 10 is made of a material that is marginally elastic or is inelastic, the child carrier cover 10 may include adjustment mechanisms, such as, for example, a series of circumferential elastic bands that help to draw in excess fabric while allowing for ease of use. Drawstrings or cinch straps 30 may also be used to draw in excess fabric. In some examples, the child carrier cover 10 may include one or more pockets 32.

Figure 6:
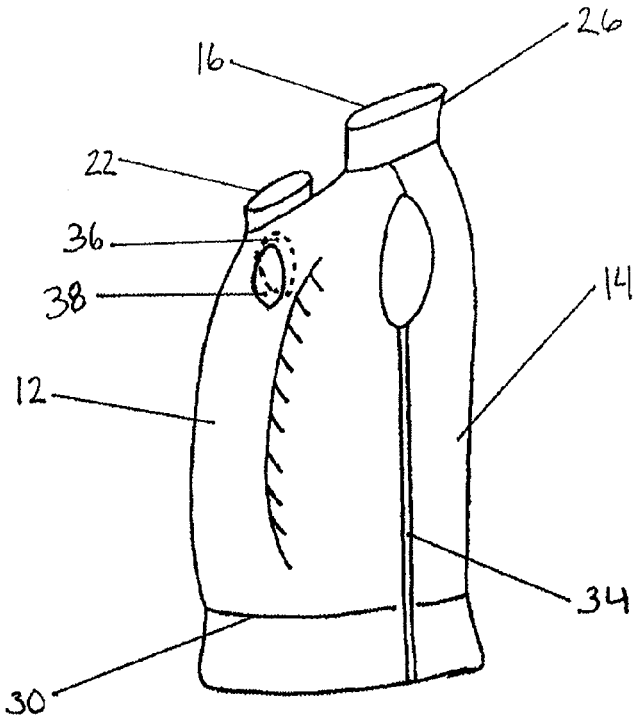
FIG. 6 is another side view of the child carrier cover.

There may also be openings oriented near the second opening 22, such as, for example, third and fourth openings 36 and 38, as shown in FIG. 6, that are designed to accommodate the hands and/or arms of the child 20. These openings may take the form of sleeves, or may simply be holes through which the majority or a portion thereof of the child's hands and/or arms may protrude. These openings allow for the child's hands and/or arms to be outside the garment, and may allow for greater interaction with the environment and the adult.

Figure 5:
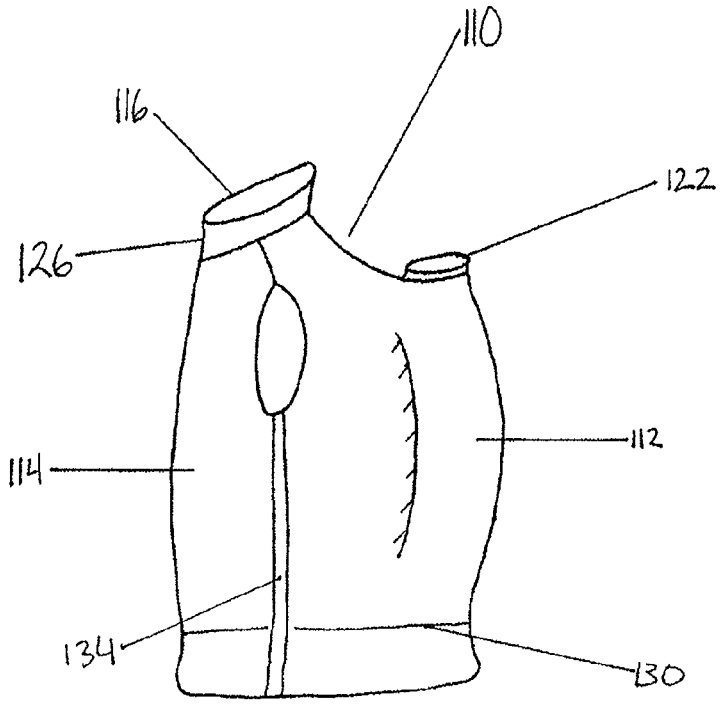
FIG. 5 is a side view of a child carrier cover.

As shown in FIG. 5, the present invention may also accommodate a child carrier device 24 that orients the child 20 on the back side of adult 18. According to an embodiment of the present invention, the child carrier cover 110 may include a first side 112, a second side 114 and an aperture 134. The child carrier cover 110 may further include a first opening 116 and a second opening 122, each of which may be defined by a collar 126. The child carrier cover 110 may also include one or more drawstrings or cinch straps 130. By placing the second opening 22 on the second side 14 of the child carrier cover 10, the second opening 22 can accommodate a child 20 that is located on the back of adult 18. Similarly, child carrier cover 10 is designed to accommodate a child 20 that is facing adult 18 or that is facing away from adult 18, regardless of which side of the adult 18 the child 20 is located.

The foregoing illustrated embodiment has been provided solely for the purpose of illustrating the structural and functional principles of the present invention, and it is not intended to be limiting. To the contrary, the present invention is intended to encompass all variables, modifications, alterations, substitutions, and equivalents within the spirit and scope of the following claims.

What is claimed:

1. A garment for covering a user and a child supported in a child carrier, comprising:

a layer of material;

armholes constructed and arranged to accommodate the arms of the user near the user's shoulders when the garment is worn by the user;

a first hole through the layer constructed and arranged to accommodate the head of the user;

a second hole through the layer constructed and arranged to accommodate the head of the child;

an aperture on at least one side of the layer, wherein the aperture extends from a bottom portion of the garment to one of the armholes; and a closure mechanism to close the aperture;

wherein the garment is constructed and arranged to be worn by the user to at least substantially cover the user's front and the user's back and the child.

2. The garment of claim 1, wherein the closure mechanism comprises a zipper, snaps, buttons, hook-and-loop, or any other appropriate mechanism.

3. The garment of claim 1, wherein the layer is constructed and arranged to cover the torso of the user, a child carrying device worn by the user, and the child located within the child carrying device.

4. The garment of claim 3, wherein the first hole and the second hole are arranged to accommodate a child carried on the front side of the user.

5. The garment of claim 3, wherein the first hole and the second hole are arranged to accommodate a child carried on the back side of the user.

6. The garment of claim 1, wherein a sleeve is attached to each of the armholes.

7. The garment of claim 6, wherein the aperture extends to a portion of the one of the armholes' sleeve that is on the same side of the garment as the aperture.

8. The garment of claim 1, wherein the layer includes insulating material.

9. The garment of claim 1, wherein the layer includes water-resistant material.

10. The garment of claim 1, further comprising third and fourth holes constructed and arranged to allow the child's hands to protrude from the garment.

11. A method for covering a child in a child carrying device on a user, comprising:

constructing a layer of material sufficient to at least substantially cover the user's front and the user's back;

constructing a first hole through the layer of material arranged for receiving the head of the user;

constructing a second hole through the layer of material arranged for receiving the head of the child;

constructing armholes through the layer of material arranged to: accommodate the arms of the user, and be near the user's shoulder when the layer of material is worn by the user; and providing a side aperture in the layer of material that extends from a bottom portion of the layer of material to one of the armholes, and the side aperture being closeable.

12. The method of claim 11, wherein:

constructing the side aperture for securing the layer of material to the user by closing the side aperture.

13. The method of claim 12, wherein the securing includes fastening a first end of the layer of material to a second end of the layer of material.

14. The method of claim 12, further comprising securing the layer of material to the user by zipping the side aperture closed.

15. The garment of claim 1, wherein no sleeve is attached to each of the armholes.

16. The method of claim 11 further comprising attaching a sleeve to each of the armholes.

17. The method of claim 11, further comprising attaching no sleeve to the armholes causing a garment, comprising the layer of material to be sleeveless.

18. The method of claim 11, further comprising providing third and fourth holes constructed and arranged to allow the child's hands to protrude from the layer of material.

19. The method of claim 11, wherein constructing the layer of material comprises sewing a first side to a second side, the first side is constructed to substantially cover the front of the user and the second side is constructed to substantially cover the back of the user.

* * * * *